US006363913B1

(12) United States Patent
Milam et al.

(10) Patent No.: US 6,363,913 B1
(45) Date of Patent: Apr. 2, 2002

(54) SOLID STATE LIFT FOR MICROMETERING IN A FUEL INJECTOR

(75) Inventors: David M. Milam, Metamora; Thomas S. Carroll, Peoria, both of IL (US); Chien-Chang Lee, Rochester Hills, MI (US); Charles R. Miller, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/593,625

(22) Filed: Jun. 9, 2000

(51) Int. Cl.[7] ..... F02M 33/02
(52) U.S. Cl. ..... 123/446
(58) Field of Search ..... 123/498, 446, 123/496, 467; 239/102.2

(56) References Cited

U.S. PATENT DOCUMENTS

| | | | | |
|---|---|---|---|---|
| 4,529,164 A | * | 7/1985 | Igashira et al. | 123/472 |
| 4,584,980 A | * | 4/1986 | Weiger | 123/498 |
| 4,750,706 A | * | 6/1988 | Schlagmuller | 239/102.2 |
| 4,762,300 A | * | 8/1988 | Inagaki et al. | 251/129.06 |
| 4,798,188 A | * | 1/1989 | Ito et al. | 123/498 |
| 5,199,641 A | * | 4/1993 | Hohm et al. | 123/498 |
| 5,477,824 A | | 12/1995 | Reedy | |
| 5,540,258 A | | 7/1996 | Cho | |
| 5,595,149 A | | 1/1997 | Speil et al. | |
| 5,605,134 A | * | 2/1997 | Martin | 123/498 |
| 5,634,448 A | | 6/1997 | Shinogle et al. | |
| 5,651,345 A | | 7/1997 | Miller et al. | |
| 5,655,495 A | | 8/1997 | Richards | |
| 5,664,527 A | | 9/1997 | Boudy | |
| 5,664,531 A | | 9/1997 | Kim | |
| 5,673,657 A | | 10/1997 | Cecur | |
| 5,676,106 A | | 10/1997 | Hoffman, II et al. | |
| 5,697,341 A | | 12/1997 | Ausman et al. | |
| 5,819,710 A | * | 10/1998 | Huber | 123/498 |
| 6,079,641 A | * | 6/2000 | Shinogle et al. | 239/533.4 |
| 6,196,472 B1 | * | 3/2001 | Cooke | 239/102.2 |

FOREIGN PATENT DOCUMENTS

| | | |
|---|---|---|
| GB | 1 578 131 | 11/1980 |
| GB | 2 254 886 | 10/1992 |
| GB | 2 274 682 | 8/1994 |

* cited by examiner

*Primary Examiner*—Thomas N. Moulis
(74) *Attorney, Agent, or Firm*—Eric M. Bram; Todd T. Taylor

(57) ABSTRACT

A fuel injector performs main fuel injection by raising fuel pressure in a nozzle chamber to lift a check valve member to a fully open position, and performs preinjection or micro-injection by operating a solid state motor to lift the check valve member a much smaller distance.

23 Claims, 4 Drawing Sheets

SOLID STATE LIFT FOR MICROMETERING IN A FUEL INJECTOR

This invention was made with Government support under Contract No. DE-FC05-970R22605 awarded by the Department of Energy. The Government has certain rights in this invention.

TECHNICAL FIELD

This invention relates generally to fuel injectors utilizing check valves, and more particularly to micrometering or varying fuel injection rates using a solid state motor to lift a check valve.

BACKGROUND ART

Over time, engineers have come to recognize that undesirable exhaust emissions can be reduced by having the ability to produce at least three different fuel injection rate shapes across the operating range of a given engine. These rate shapes include a ramp, a boot shape, and square fuel injection profiles. In addition to these rate shapes, there is often a need for the injector to have the ability to produce split injections in order to further improve combustion efficiency at some operating conditions, such as at idle.

Although there exist a wide variety of mechanisms for pressurizing fuel in fuel injection systems, almost all fuel injectors include a spring biased needle check valve to open and close the nozzle outlet. In almost all fuel injectors, the needle valve member is only stoppable at two different positions: fully open or fully closed. Because the needle valve members in these fuel injectors are not normally stoppable at a partially open position, fuel injection mass flow can usually be controlled only through changes in fuel pressure.

Hydraulic bias control of the check valve is also possible, such as taught in U.S. Pat. No. 6,024,296 to Wear et al. Another approach is dual nozzle design, but this is an expensive solution.

It would be advantageous to have a reliable mechanism for accurately varying check lift for rate shaping purposes. For example, reducing maximum lift of the check valve member could provide pre-metering or micrometering—that is, injecting a very small amount of fuel prior to a main injection—or post-metering. This is highly desirable in order to improve operation of the fuel injector, especially to reduce noxious emissions and/or to reduce noise of operation. Variable check lift could be advantageous at other times as well. Accurate methods of achieving very small fuel volume pre-metering or micrometering are always of interest.

While it has been proposed in the art that piezoelectric actuators could be employed in fuel injection systems, the use of piezoelectric actuators to directly control needle lift has proven somewhat problematic. First, this is due in part to the fact that only so much space is available within a fuel injector to place a piezoelectric crystal stack. Given the space limitations, the maximum piezoelectric deformation possible in the space available is generally on the order of less than about one hundred microns. Since typical needle valve lifts are on the order of several hundreds of microns, direct piezoelectric control of needle valve lift is not realistic without making substantial—and likely unrealistic—changes in the nozzle area of a fuel injector.

The present invention is directed to addressing these and other concerns associated with controlling needle valve lift within fuel injectors.

DISCLOSURE OF THE INVENTION

In one aspect of the invention, a fuel injector comprises a nozzle at least partially defining a nozzle chamber and at least one injection orifice. A check valve member extends into the nozzle chamber and is slidably disposed in a nozzle body between a first position in which the check valve member obstructs fluid communication between the nozzle chamber and the injection orifice and a second position in which the nozzle chamber and the injection orifice are in fluid communication. A solid state motor in the nozzle body is capable of moving the check valve member toward the second position.

In another aspect of the invention, a method is given for operating a fuel injector having a check valve member slidably disposed in a nozzle body and movable through a range of motion. The range of motion includes a first position in which the check valve member obstructs fluid communication between a nozzle chamber in the nozzle body and at least one orifice in the nozzle body, a second position in which the nozzle chamber and the orifice are in fluid communication, and a third position between the first position and the second position, and substantially closer to the first position than to the second position, in which the check valve member substantially but not entirely restricts fluid communication between the nozzle chamber and the orifice. The method comprises a fuel pressurization step of increasing fuel pressure in the nozzle chamber, a micrometering injection step of operating a solid state motor in the nozzle body to slide the check valve member from the first position to stop at the third position, and a main injection step of increasing fuel pressure in the nozzle chamber to a pressure level sufficient to slide the check valve member in the nozzle body to the second position.

BRIEF DESCRIPTION OF THE DRAWINGS

Features of the invention can be better understood with reference to the drawing figures, in which certain dimensions may be exaggerated to illustrate check valve movement for example, and in which.

BEST MODE FOR CARRYING OUT THE INVENTION

The invention is now described with reference to FIGS. 1–4*b,* which illustrate a fuel injector 10 and check valve portion 12 thereof utilizing the invention.

Figure 1:
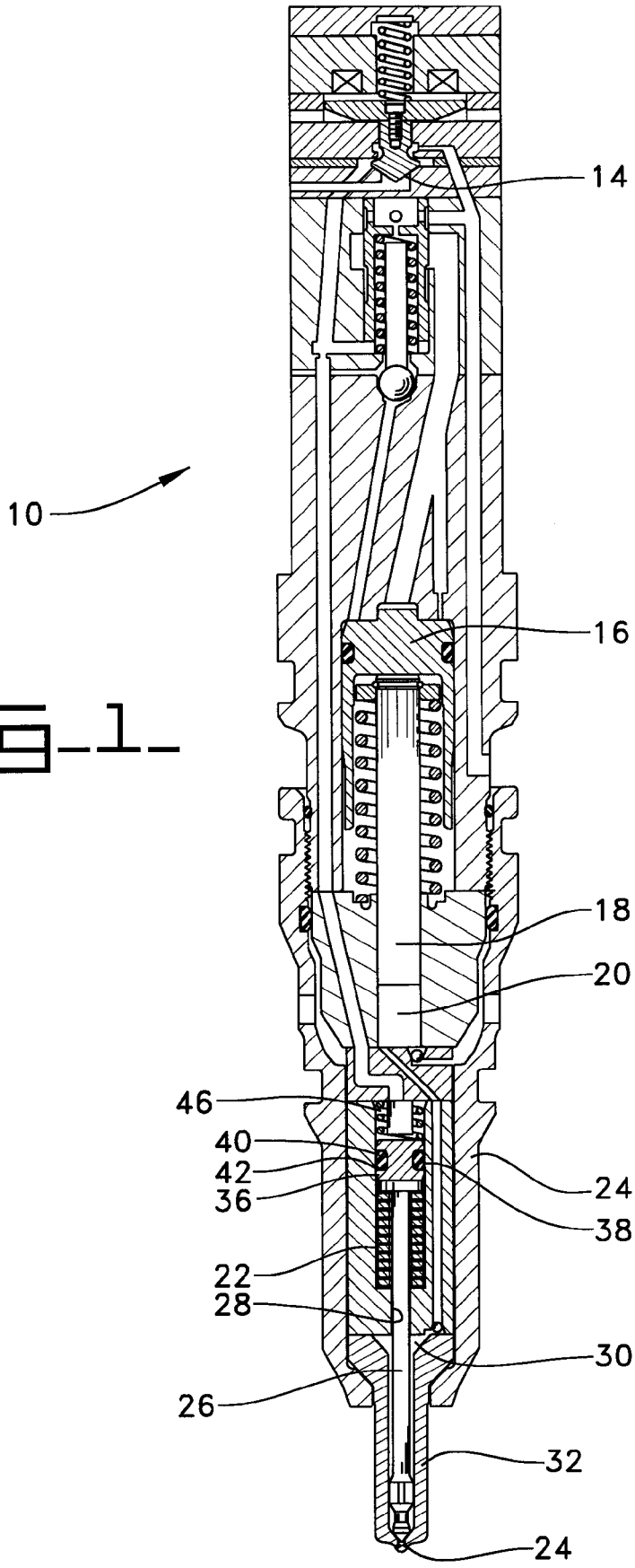
FIG. 1 is a diagrammatic side view representation of a fuel injector utilizing a solid state lift according to the invention.

The fuel injector 10 in this embodiment, shown in FIG. 1, is a hydraulically actuated fuel injector and has an electronically controlled actuator 14. In the illustrated embodiment the actuator 14 utilizes a solenoid, but other types of electronically controlled actuators, for example piezo or magnetostrictive, may be used. In other embodiments mechanical actuators may be used.

An intensifier piston 16 is slidably disposed in the fuel injector 10. Beneath the intensifier piston 16 is a plunger 18 partially defining a fuel pressure control cavity 20. In other embodiments the plunger 18 may be integral with the intensifier piston 16.

FIGS. 2–4*b* show a check valve portion 12 of the fuel injector 10 in greater detail. A solid state motor 22 is disposed in a nozzle body 24 against a check valve member 26. The solid state motor 22 can be an expansion device composed of any electrically or magnetically expandable material, piezo or magnetostrictive for example. The device or the material from which it is made may expand when energized, as with a standard piezo stack for example, or may contract when energized, for example when using a thermally pre-stressed, bending unimorph piezo device comprising ferroelectric wafers such as those described in U.S. Pat. No. 5,632,841 assigned to the National Aeronautics and Space Administration (NASA).

The check valve member 26 is slidably disposed in a check bore 28 in the nozzle body 24, and extends into a nozzle chamber 30 in a nozzle 32. The nozzle 32 has at least one injection orifice 34. Above the check valve member 26 is a check piston 36 that can be a separate piece from the check valve member 26 as in the illustrated embodiment, or can be attached to, or can even be part of, the check valve member 26.

In the embodiment illustrated in FIGS. 1–4*a* the check piston 36 incorporates a glide ring seal 38 comprising a rubber energizer or O-ring 40 and a nylon wear surface 42. The check piston 36 with the glide ring seal 38 is slidably disposed in a check piston bore 44. FIG. 4*b* shows an alternate embodiment of a check piston 36' without the glide ring seal 38.

A check control chamber 46 is partially defined by a closing hydraulic surface 48 of the check piston 36. In the illustrated embodiment a mechanical bias 50 such as a spring for example in the check control chamber 46 pushes downward on the check piston 36. A check stop 52 also extends into the check control chamber 46 in the illustrated embodiment.

Industrial Applicability

Figure 2:
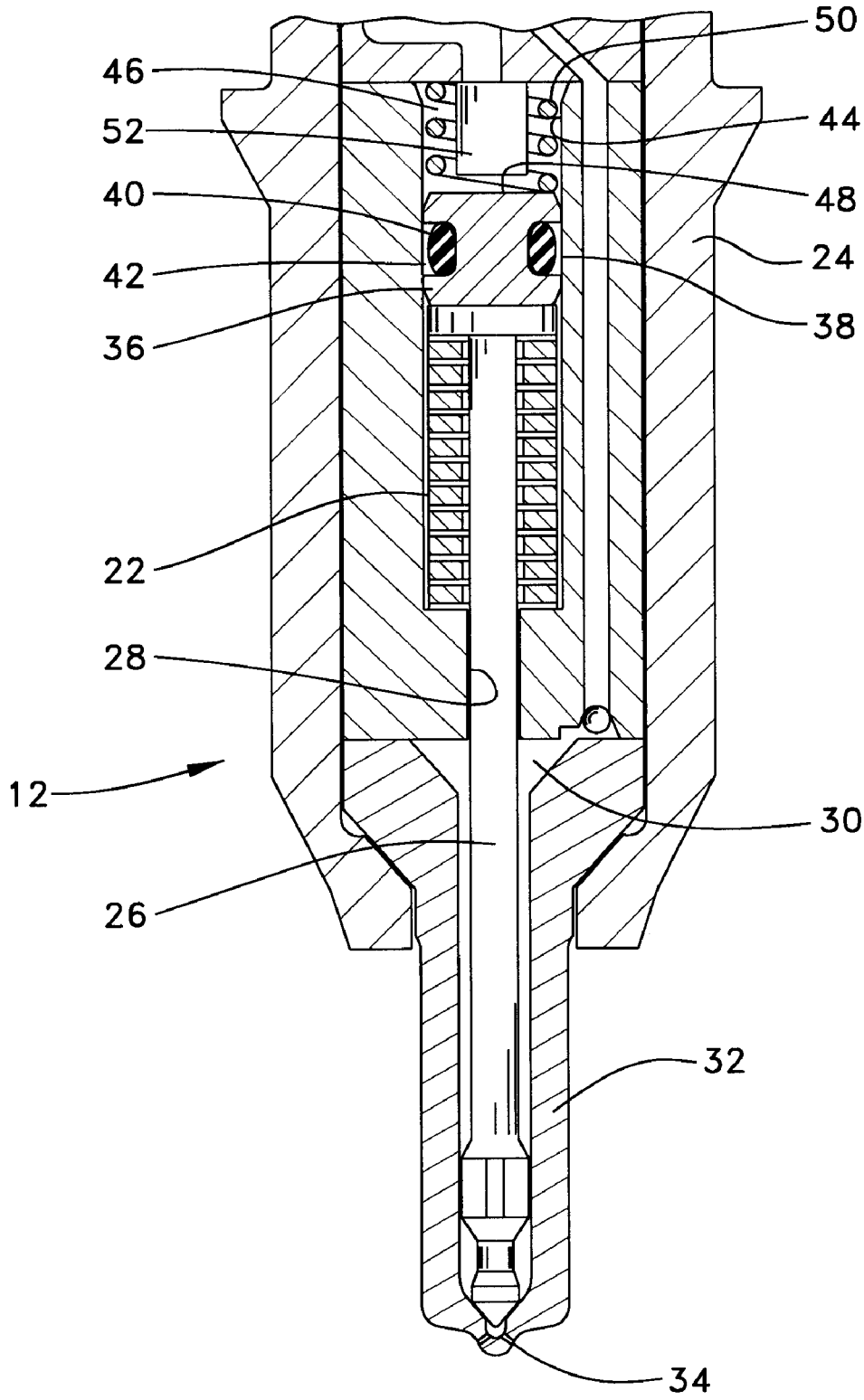
FIG. 2 is a diagrammatic side view representation of a check valve portion of the fuel injector of FIG. 1 with the check in a first position.
Figure 3:
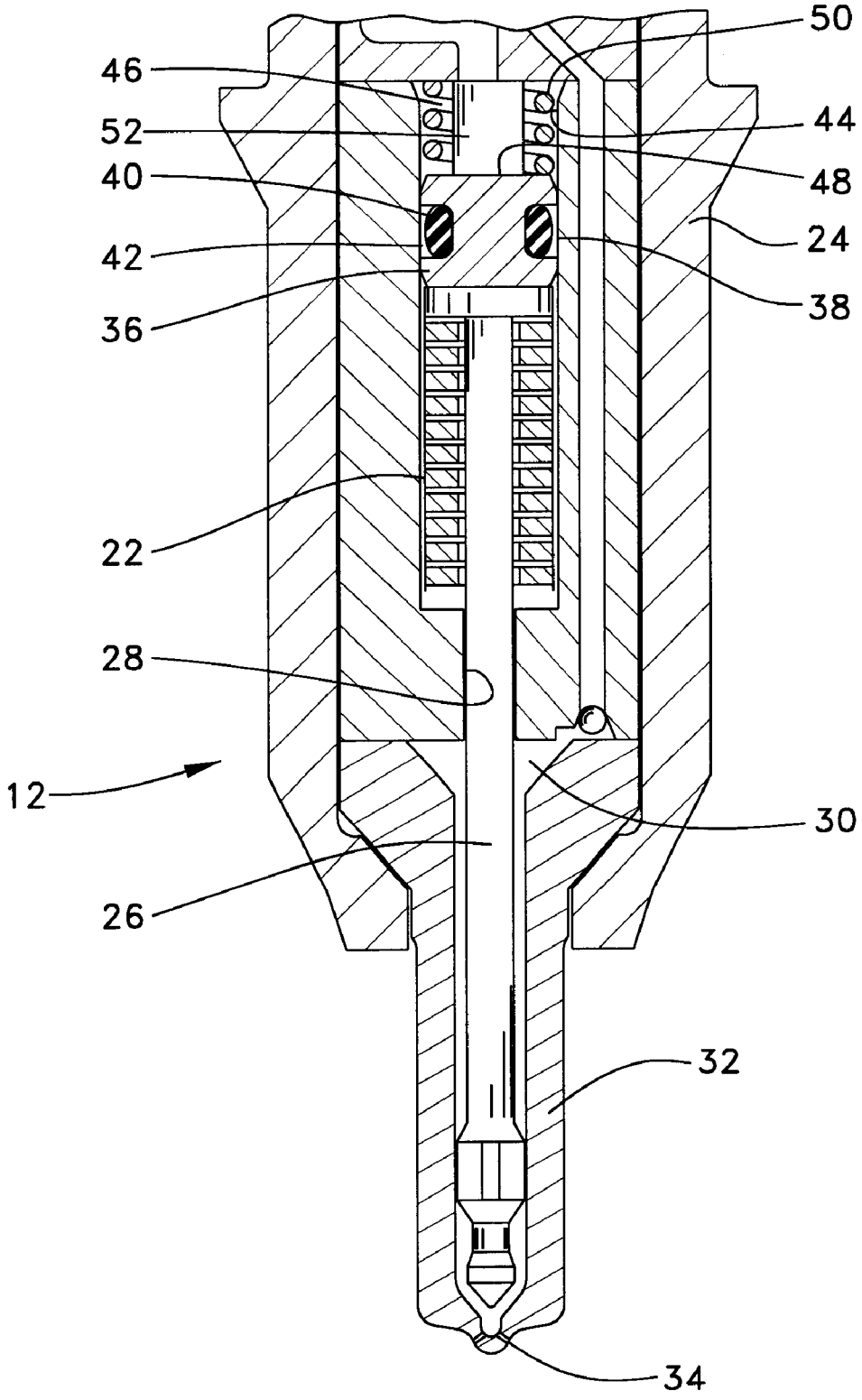
FIG. 3 is a diagrammatic side view representation of the check valve portion of FIG. 2 with the check in a second position.

The fuel injector 10 in the illustrated embodiment of FIGS. 1 and 2 is a hydraulically actuated fuel injector with direct check control utilizing the invention. Of course, it will be understood that the invention can also be practiced in a hydraulically actuated fuel injector without direct check control, as well as in a non-hydraulically (i.e., mechanically) actuated fuel injector with or without direct check control.

Fuel injection occurs when the check valve member 26 is pulled or pushed upward so that high pressure fuel in the nozzle chamber 30 can pass through the injection orifice 34. Usually there will be more than one injection orifice 34 arranged for efficient fuel injection.

The check valve member 26 is usually biased downward to keep it from opening, that is, to keep the check valve member 26 in a first position, i.e., a "closed" position, shown in FIG. 2, in which it is pressed against the nozzle 32 to fluidly isolate the injection orifice 34 from the nozzle chamber 30. This bias may be mechanical or hydraulic.

The illustrated embodiment uses both mechanical and hydraulic bias to keep the check valve member 26 biased toward the first position. The mechanical bias 50 presses downward on the check piston 36. Additionally, high-pressure hydraulic fluid can be diverted to the check control chamber 46 to apply additional downward bias against the check piston 36.

Main fuel injection occurs when fuel pressure in the nozzle chamber 30 is increased until the fuel pressure in the nozzle chamber 30 overcomes the mechanical and/or hydraulic bias keeping the check valve member 26 in the first position. When this happens the check valve member 26 slides upward to a second position, i.e., an "open" position, shown in FIG. 3. In the illustrated embodiment upward movement of the check valve member 26 is terminated by contact with the check stop 52. Other embodiments could dispense with the check stop 52, relying on mechanical and/or hydraulic bias to halt upward movement of the check valve member 26.

In the illustrated embodiment fuel pressure in the nozzle chamber 30 is increased for main fuel injection by causing the actuator 14 to direct high-pressure actuation fluid to push against the intensifier piston 16. This in turn pushes the plunger 18 further into the fuel pressure control cavity 20, which raises fuel pressure in both the fuel pressure control cavity 20 and in the nozzle chamber 30 to which it is fluidly connected.

Main fuel injection ends when the total bias pushing the check valve member 26 toward the first position exceeds the fuel pressure in the nozzle chamber 30. This can be accomplished by reducing fuel pressure in the nozzle chamber 30, by increasing downward bias against the check valve member 26, or by a combination of those two methods.

In the illustrated embodiment fuel pressure in the nozzle chamber 30 can be reduced by operating the actuator 14 to release hydraulic fluid pressure from pushing on the intensifier piston 16, thereby allowing the plunger 18 to move upward again. Of course, in other fuel injector embodiments other methods of increasing and decreasing fuel pressure in the nozzle chamber 30 may be used with the invention.

In the illustrated embodiment the downward bias against the check valve member 26 can be increased to end main fuel injection by operating the actuator 14 to direct high-pressure actuation fluid into the check control chamber 46. Of course, in other fuel injector embodiments other methods of increasing downward bias against the check valve member 26 to end main fuel injection may be used with the invention. In some embodiments a constant mechanical or other bias may be used. In other embodiments utilizing the invention a hydraulic bias, either constant or variable, may be used in place of the mechanical bias 50. Still other embodiments may use combinations of these methods for providing bias when utilizing the invention.

Figure 4A:
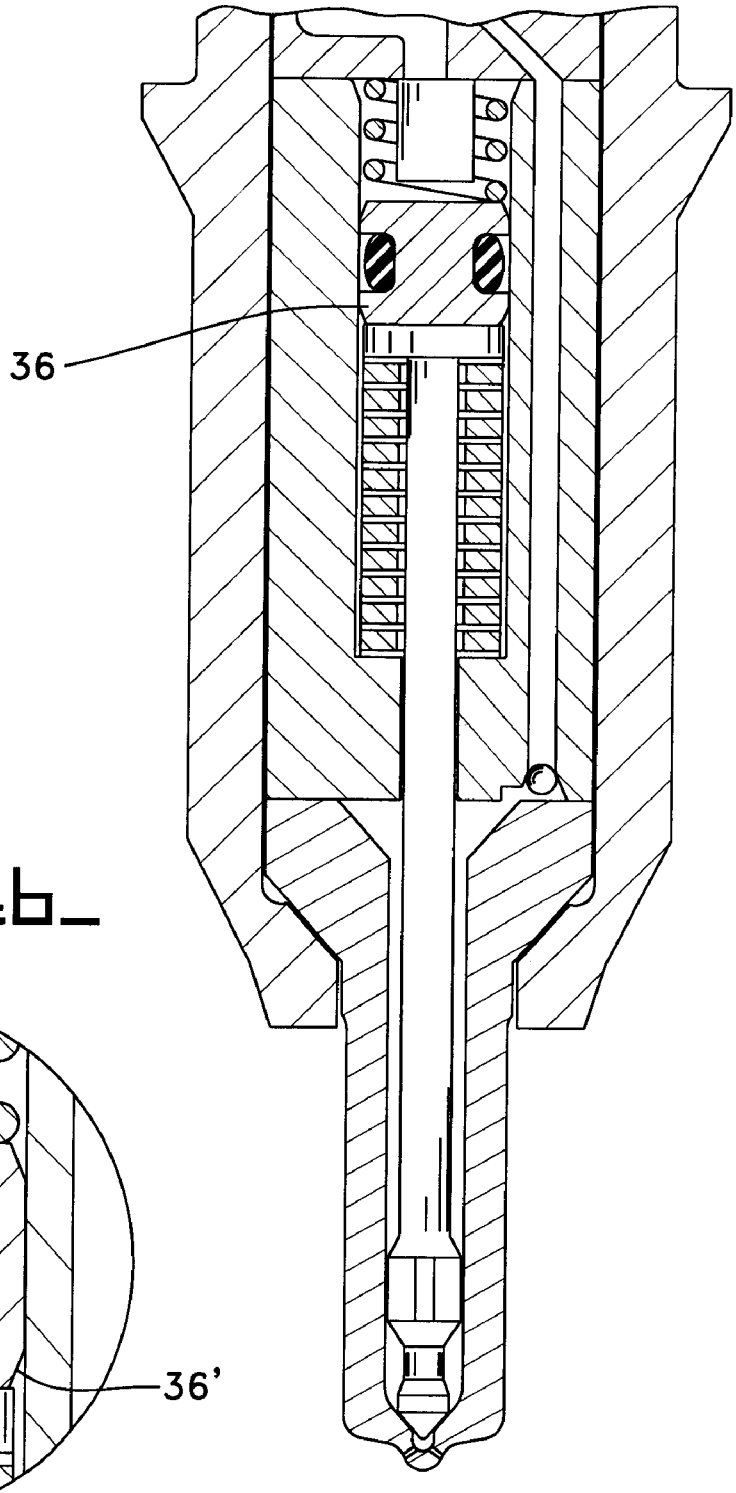
FIG. 4*a* is a diagrammatic side view representation of the check valve portion of FIG. 2 with the check in a third position.
Figure 4B:
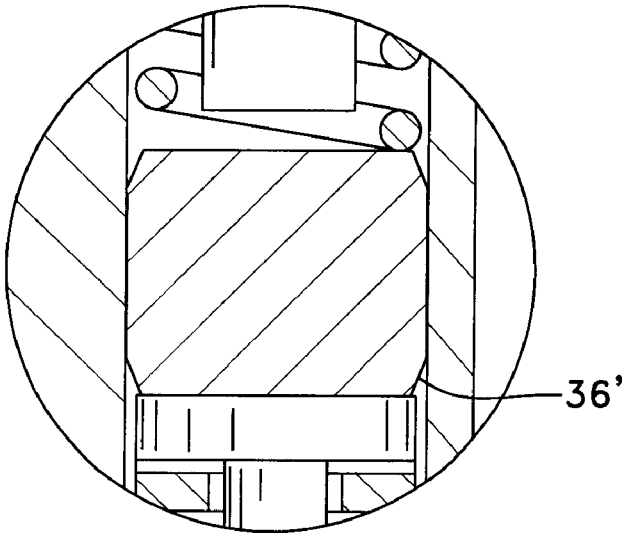
FIG. 4*b* is a diagrammatic side view representation of an alternate embodiment of a check piston that can be used with the invention.

Micrometering injection occurs when the solid state motor 22 is changed from a first energy state in which the check valve member 26 can slide to or remain at the first position, to a second energy state in which the solid state motor 22 pulls or pushes the check valve member 26 upward to a third position, i.e., a "micrometering" position, shown in FIG. 4*a*. This movement is generally very small compared with the movement of the check valve member 26 from the first position to the second position, so that in the third position the check valve member 26 still substantially but not entirely restricts fuel in the nozzle chamber 30 from reaching the injection orifice 34. This allows a small amount of highly pressurized fuel to be ejected for pre-metering or micrometering, but much less than would be expected for the main injection.

Micrometering injection ends either when main fuel injection begins, or when the solid state motor 22 is changed from the second energy state back to the first energy state, allowing the downward bias on the check valve member 26 to push the check valve member 26 back to the first position.

Any number of fuel injection sequence combinations can be imagined. For example, before fuel pressure in the nozzle chamber 30 is high enough to push open the check valve member 26 to the second position against the bias of the check spring, the solid state motor 22 can move the check valve member 26 to the third position for pre-metering. Then, fuel pressure in the nozzle chamber 30 can be raised to move the check valve member 26 from the third position to the second position for main fuel injection. Or, the solid state motor 22 can release the check valve member 26 allowing it to return to the first (closed) position before fuel pressure in the nozzle chamber 30 is high enough to offset the bias downward against the check valve member 26, to cause a pause in micrometering before main injection begins.

Or, in the case of a fuel injector with direct check control, the solid state motor 22 can be operated to raise the check valve member 26 from the first (closed) position to the third (micrometering) position even while actuation fluid pressure in the check control chamber 46 is high enough to prevent the check valve member 26 from being opened in response to high fuel pressure in the nozzle chamber 30. Any number of such combinations can be easily imagined.

Additionally, the solid state motor 22 can move the check valve member 26 to a fourth position different from the third position, or to any of a plurality of different positions, by varying the current or magnetic field applied to the solid state motor 22 (piezo or magnetostrictive type, for example). In this way the amount of fuel injected during micrometering injection can be varied. In this way the solid state motor 22 can move the check valve member 26 from the first position to any of the plurality of positions, or from one of the plurality of positions to another.

In the illustrated embodiment, the glide ring seal 38 of the check piston 36 fluidly isolates hydraulic fluid in the check control chamber 46 from any fuel that may have seeped through the check bore 28 from the nozzle chamber 30. The nylon wear surface 42 of the glide seal ring 38 provides good wear characteristics but has little or no elasticity, so the rubber energizer 40 pushes it against the check piston bore 44.

In embodiments using a fuel injector without direct hydraulic check control there may be no need for high-pressure hydraulic actuation fluid in the check control chamber 46, and thus the check piston 36 with the glide ring seal 38 may not be necessary. In that case the check piston 36 could be merely a top portion of the check valve member 26.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

What is claimed is:

1. A fuel injector comprising:

a nozzle at least partially defining a nozzle chamber and at least one injection orifice;

a check valve member extending into the nozzle chamber and slidably disposed in a nozzle body between a first position in which the check valve member obstructs fluid communication between the nozzle chamber and the injection orifice and a second position in which the nozzle chamber and the injection orifice are in fluid communication;

a solid state motor in the nozzle body capable of moving the check valve member toward said second position; and a hydraulic fluid system for delivering a high-pressure hydraulic fluid therethrough, the hydraulic fluid system being capable of selectively diverting the high-pressure hydraulic fluid in such a manner so as to thereby be adapted to bias the check valve member toward said first position and adapted to enable a pressure increase in the nozzle chamber.

2. The fuel injector of claim 1, further comprising a mechanical bias biasing the check valve member toward said first position.

3. A fuel injector comprising:

a nozzle at least partially defining a nozzle chamber and at least one injection orifice;

a check valve member extending into the nozzle chamber and slidably disposed in a nozzle body between a first position in which the check valve member obstructs fluid communication between the nozzle chamber and the injection orifice and a second position in which the nozzle chamber and the injection orifice are in fluid communication;

a check control chamber fluidly isolated from the nozzle chamber and fillable with high-pressure hydraulic fluid such that fluid pressure of the high-pressure hydraulic fluid in the check control chamber will bias the check valve member toward said first position; and a solid state motor in the nozzle body capable of moving the check valve member toward said second position.

4. The fuel injector of claim 3, further comprising a mechanical bias in the check control chamber that biases the check valve member toward said first position.

5. The fuel injector of claim 3, wherein said solid state motor is a piezo device.

6. The fuel injector of claim 3, further comprising glide ring seal means for fluidly isolating the check control chamber from the nozzle chamber.

7. The fuel injector of claim 1, wherein said solid state motor is a piezo device.

8. The fuel injector of claim 1, wherein said solid state motor is a magnetostrictive device.

9. A fuel injector comprising:

a nozzle at least partially defining a nozzle chamber and at least one injection orifice;

a check valve member extending into the nozzle chamber and slidably disposed in a nozzle body between a first position in which the check valve member obstructs fluid communication between the nozzle chamber and the injection orifice and a second position in which the nozzle chamber and the injection orifice are in fluid communication;

a solid state motor in the nozzle body capable of moving the check valve member toward said second position;

an intensifier piston slidably disposed in the fuel injector and operable to increase fuel pressure in the nozzle chamber; and an actuator operable to divert high-pressure actuation fluid to the intensifier piston.

10. The fuel injector of claim 3, further including a glide ring seal apparatus which fluidly isolates the check control chamber from the nozzle chamber.

11. A method for operating a fuel injector having a check valve member slidably disposed in a nozzle body and movable through a range of motion, the range of motion including:

a first position in which the check valve member obstructs fluid communication between a nozzle chamber in the nozzle body and at least one orifice in the nozzle body;

a second position in which the nozzle chamber and the orifice are in fluid communication; and a third position between the first position and the second position, and substantially closer to the first position than to the second position, in which the check valve member substantially but not entirely restricts fluid communication between the nozzle chamber and the orifice, the method comprising:

a fuel pressurization step of increasing fuel pressure in the nozzle chamber;

a micrometering injection step of operating a solid state motor in the nozzle body to slide the check valve member from the first position to stop at the third position; and a main injection step of increasing fuel pressure in the nozzle chamber to a pressure level sufficient to slide the check valve member in the nozzle body to the second position.

12. The method of claim 11, further comprising operation the solid state motor to slide the check valve member to stop at a fourth position different from the third position.

13. The method of claim 11, further comprising performing the main injection step when the micrometering injection step has been performed and the check valve member is at the third position.

14. The method of claim 11, further comprising:

operating the solid state motor to slide the check valve member from the third position to the first position; and performing the main injection step when the check valve member is at the first position.

15. The method of claim 11, further comprising performing the micrometering injection step when the check valve member is at an intermediate position between the first position and the second position.

16. The method of claim 11, further comprising using a mechanical bias to bias the check valve member toward the first position.

17. The method of claim 11, further comprising diverting high-pressure hydraulic fluid to a check control chamber fluidly isolated from the nozzle chamber to bias the check valve member toward the first position.

18. The method of claim 11, wherein the fuel pressurization step comprises using high-pressure hydraulic fluid to drive a plunger to increase fuel pressure in a fuel pressure control cavity by decreasing the volume of the fuel pressure control cavity.

19. The method of claim 18, further comprising electronically operating an actuator to divert high-pressure actuating fluid to an intensifier piston to drive the plunger.

20. The method of claim 19, further comprising causing the check valve member to slide from the second position to one of the first position and the third position by diverting high-pressure hydraulic fluid to a check control chamber fluidly isolated from the nozzle chamber.

21. The method of claim 11, wherein the solid state motor is a magnetostrictive device.

22. The method of claim 11, wherein the solid state motor is a piezo device.

23. The method of claim 22, wherein the micrometering injection step is performed by deenergizing the piezo device.

* * * * *